US009656150B2

(12) United States Patent
Tan

(10) Patent No.: US 9,656,150 B2
(45) Date of Patent: May 23, 2017

(54) GLOVE

(71) Applicant: Stefan B. Tan, Chino Hills, CA (US)

(72) Inventor: Stefan B. Tan, Chino Hills, CA (US)

( * ) Notice: Subject to any disclaimer, the term of this patent is extended or adjusted under 35 U.S.C. 154(b) by 321 days.

(21) Appl. No.: 14/333,192

(22) Filed: Jul. 16, 2014

(65) Prior Publication Data

US 2016/0016065 A1 Jan. 21, 2016

(51) Int. Cl.

| | |
|---|---|
| ***A63B 71/00*** | (2006.01) |
| ***A63B 71/14*** | (2006.01) |
| ***A41D 19/015*** | (2006.01) |

(52) U.S. Cl.

CPC ..... *A63B 71/146* (2013.01); *A41D 19/01576* (2013.01); *A63B 71/141* (2013.01); *A63B 2209/10* (2013.01)

(58) Field of Classification Search

CPC ..... A41D 19/01576
USPC ..... 2/161.2, 161.4
See application file for complete search history.

(56) References Cited

U.S. PATENT DOCUMENTS

| | | | | |
|---|---|---|---|---|
| 6,154,885 | A * | 12/2000 | Kobayashi et al. | 2/161.3 |
| 6,216,276 | B1 * | 4/2001 | Eibert | 2/161.2 |
| 6,405,380 | B1 * | 6/2002 | Kuroda et al. | 2/161.1 |
| 6,415,445 | B1 * | 7/2002 | Nishijima et al. | 2/161.4 |
| 7,882,571 | B2 * | 2/2011 | Robba et al. | 2/161.2 |
| 2006/0026738 | A1 * | 2/2006 | Kleinert | 2/163 |
| 2007/0083968 | A1 * | 4/2007 | Stokes | 2/16 |
| 2007/0226873 | A1 * | 10/2007 | Mattesky | 2/159 |
| 2010/0077526 | A1 * | 4/2010 | Smeltzer | 2/16 |
| 2010/0186142 | A1 * | 7/2010 | Kume et al. | 2/161.1 |
| 2010/0275342 | A1 * | 11/2010 | Sweeney et al. | 2/167 |
| 2012/0227155 | A1 * | 9/2012 | Brown | 2/159 |
| 2013/0263356 | A1 * | 10/2013 | Jones et al. | 2/163 |
| 2014/0143926 | A1 * | 5/2014 | Brown et al. | 2/20 |

* cited by examiner

*Primary Examiner* — Khaled Annis
(74) *Attorney, Agent, or Firm* — John K. Park; Park Law Firm

(57) ABSTRACT

A glove comprises tip-covering portions, joint-covering portions, and surface-covering portions. Each of the tip-covering portions is made of a first material and configured to cover each palm or back side of tip portions of fingers. Each of the joint-covering portions is made of a second material, connected to corresponding one of the tip-covering portions, and configured to cover one of palm or back side of joint portions of the fingers. Each of the surface-covering portions is made of a third material, connected to at least one of the tip-covering portions and the joint-covering portions, and configured to cover surface portions other than hand portions covered by the tip-covering portions or the joint-covering portions. The second material is more flexible than the first or third material, so that the glove has one size and multi-size feature.

20 Claims, 4 Drawing Sheets

GLOVE

BACKGROUND OF THE INVENTION

The present invention relates to a glove. More particularly, this invention relates to a glove, which provides more convenience.

Accordingly, a need for convenient gloves has been present for a long time considering the expansive demands in activities of the everyday life. This invention is directed to solve these problems and satisfy the long-felt need.

SUMMARY OF THE INVENTION

The present invention contrives to solve the disadvantages of the prior art.

An object of the invention is to provide a gloves with a plurality parts.

The glove comprises a plurality of tip-covering portions, a plurality of joint-covering portions, and a plurality of surface-covering portions.

Each of the plurality of tip-covering portions is made of a first material and configured to cover each palm or back side of tip portions of fingers.

Each of the plurality of joint-covering portions is made of a second material, connected to corresponding one of the plurality of tip-covering portions, and configured to cover one of palm or back side of joint portions of the fingers.

Each of the plurality of surface-covering portions is made of a third material, connected to at least one of the plurality of tip-covering portions and the plurality of joint-covering portions, and configured to cover surface portions other than hand portions covered by the tip-covering portions or the joint-covering portions.

The second material is more flexible than the first or third material.

The plurality of joint-covering portions may cover at least some of proximal inter-phalangeal joints of the fingers.

The plurality of surface-covering portions may comprise a first matacarpal-phalangeal joint surface-covering portion disposed over and configured to cover at least some of back sides of matacarpal-phalangeal joints.

The plurality of surface-covering portions may comprise a back surface-covering portion disposed over and configured to cover a partial back side of the hand portion.

The glove may further comprise one or more back-dividing portions made of the second material and disposed between the first matacarpal-phalangeal joint surface-covering portion and the back surface-covering portion.

The plurality of surface-covering portions comprise a second matacarpal-phalangeal joint surface-covering portion disposed over and configured to cover at least one of palm sides of matacarpal-phalangeal joints.

The plurality of surface-covering portions may comprise a palm surface-covering portion disposed over and configured to cover a partial palm side of the hand portion.

The glove may further comprise one or more palm-dividing portions made of the second material and disposed between the second matacarpal-phalangeal joint surface-covering portion and the palm surface-covering portion.

The glove may further comprise a back-side thumb-dividing portion and a palm-side thumb-dividing portion.

The back-side thumb-dividing portion is made of the second material and disposed between a thumb portion of the glove and the back side of the hand.

The palm-side thumb-dividing portion is made of the second material and disposed between the thumb portion of the glove and the palm side of the hand.

The back-side thumb-dividing portion may be connected with the palm-side thumb-dividing portion.

The back-side thumb-dividing portion and the palm-side thumb-dividing portion may be connected with one of the one or more back-dividing portions for an index finger.

The glove may further comprise a plurality of first finger-side-covering portions, each of which being disposed over and configured to cover a side portion of finger, and each of the plurality of first finger-side-covering portions may be disposed between and connects two of the plurality of tip-covering portions covering palm and back of a tip portion of finger, respectively.

The first finger-side-covering portions may be made of a fourth material, wherein the second material is more flexible than the fourth material.

The glove may further comprise a plurality of second finger-side-covering portions, each of which being disposed over and configured to cover remaining side portion of finger. Each of the plurality of second finger-side-covering portions may be disposed between and connects two of the plurality of joint-covering portions covering palm and back of a tip portion of finger, respectively, and an end of one of the plurality of second finger-side-covering portions may be connected with an end of neighboring one of the plurality of first finger-side-covering portions.

The second finger-side-covering portions may be made of a fifth material, wherein the second material is more flexible than the fifth material.

The second material may be more flexible than the first or third material and stretchable, such that the glove fits for a plurality of different sizes.

The advantages of the present invention are: (1) the glove according to the invention provides flexibility and strength at the same time; (2) the glove according to the invention can be used very comfortably in sports such as golf; and (3) the glove has an one size/multi-size feature.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

Figure 1:
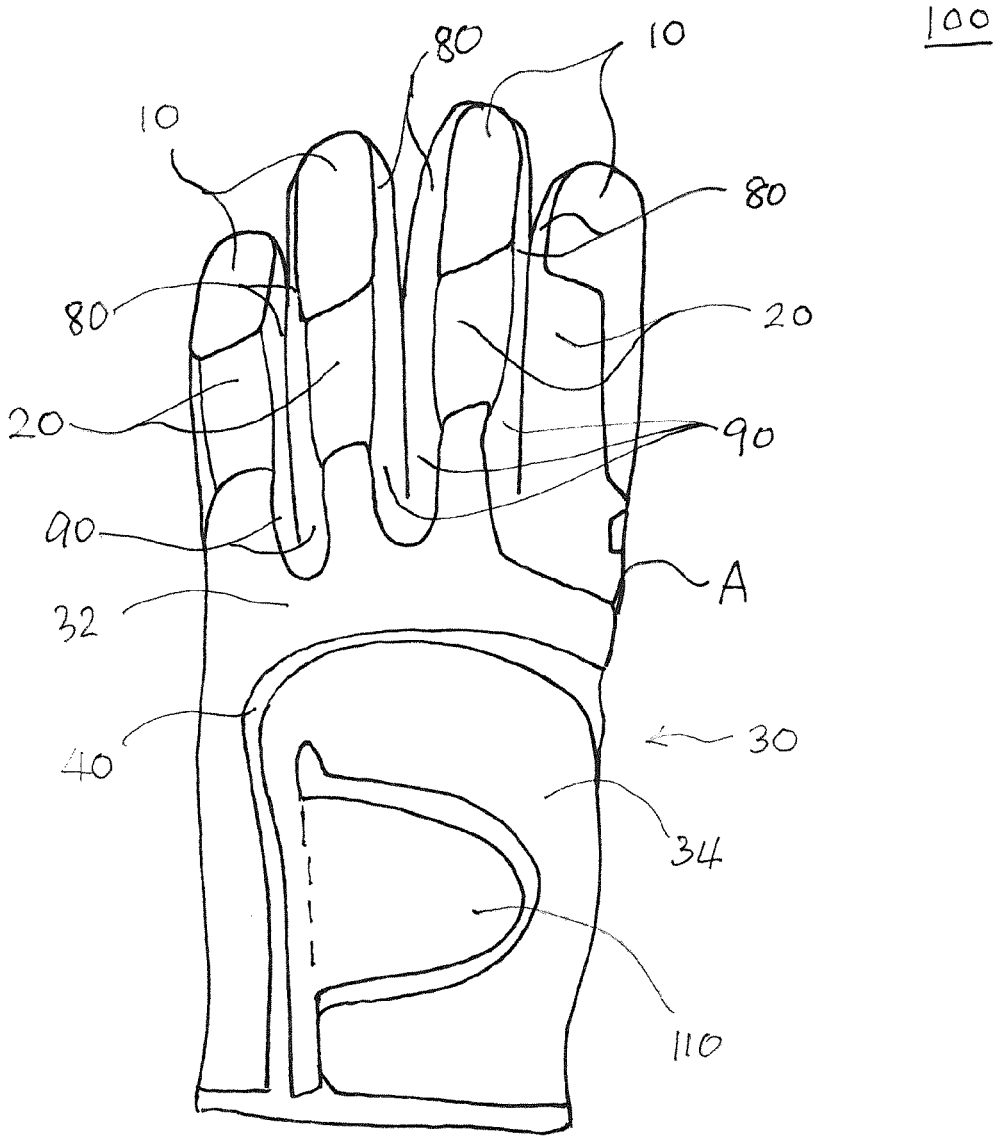
FIG. 1 is a perspective view showing a back portion of a glove according to an embodiment.
Figure 2:
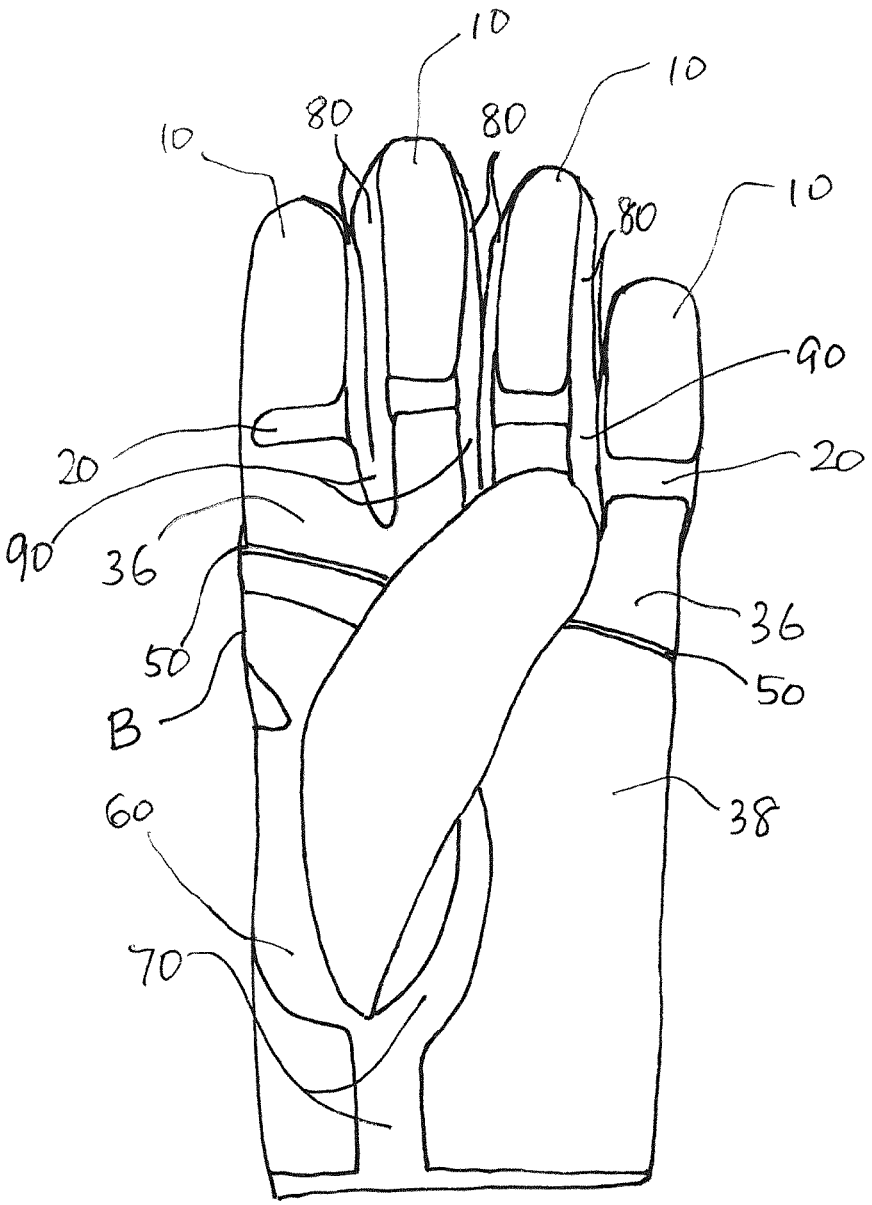
FIG. 2 is a perspective view showing a palm portion of the glove of FIG. 1.
Figure 3:
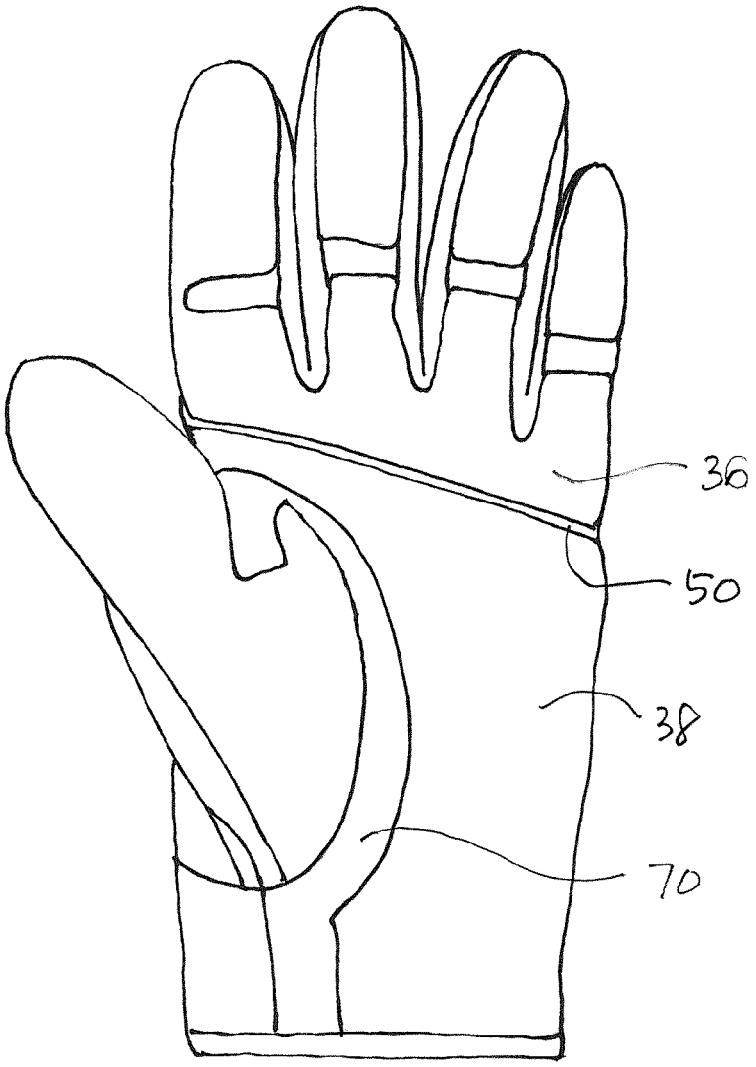
FIG. 3 is another perspective view showing the palm portion of the glove of FIG. 1.

FIGS. 1 through 3 show a glove 100 according to an embodiment of the invention.

An object of the invention is to provide a gloves with a plurality parts for protecting hand and fingers 900 and a plurality of flexible parts provided among the protecting parts.

The glove 100 comprises a plurality of tip-covering portions 10, a plurality of joint-covering portions 20, and a plurality of surface-covering portions 30.

Each of the plurality of tip-covering portions 10 is made of a first material and configured to cover each palm or back side of tip portions of fingers.

Each of the plurality of joint-covering portions 20 is made of a second material, connected to corresponding one of the plurality of tip-covering portions 10, and configured to cover one of palm or back side of joint portions of the fingers.

Each of the plurality of surface-covering portions 30 is made of a third material, connected to at least one of the plurality of tip-covering portions 10 and the plurality of joint-covering portions 20, and configured to cover surface portions other than hand portions covered by the tip-covering portions 10 or the joint-covering portions 20.

The second material is more flexible than the first or third material.

Figure 4:
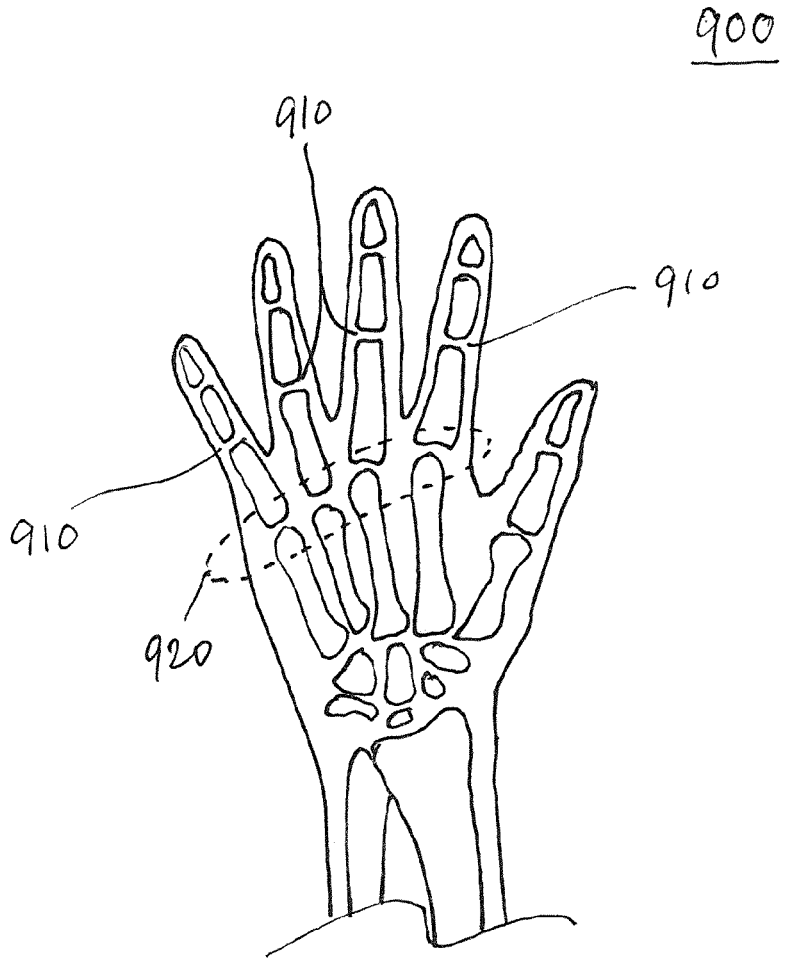
FIG. 4 is a schematic diagram showing an anatomy of hand for describing glove parts.

The plurality of joint-covering portions 20 may cover at least some of proximal inter-phalangeal joints 910 of the fingers. For the portions of the hand 900, refer to FIG. 4. Of course, any hands or fingers of human body are not included in the invention. FIG. 4 is just for describing corresponding parts of the glove 100 according to the invention.

The plurality of surface-covering portions 30 may comprise a first matacarpal-phalangeal joint surface-covering portion 32 disposed over and configured to cover at least some of back sides of matacarpal-phalangeal joints 920.

The plurality of surface-covering portions 30 may comprise a back surface-covering portion 34 disposed over and configured to cover a partial back side of the hand 900.

The glove may further comprise one or more back-dividing portions 40 made of the second material and disposed between the first matacarpal-phalangeal joint surface-covering portion 32 and the back surface-covering portion 34.

The plurality of surface-covering portions 30 comprise a second matacarpal-phalangeal joint surface-covering portion 36 disposed over and configured to cover at least one of palm sides of matacarpal-phalangeal joints 920.

The plurality of surface-covering portions 30 may comprise a palm surface-covering portion 38 disposed over and configured to cover a partial palm side of the hand 900.

The glove 100 may further comprise one or more palm-dividing portions 50 made of the second material and disposed between the second matacarpal-phalangeal joint surface-covering portion 36 and the palm surface-covering portion 38.

The glove 100 may further comprise a back-side thumb-dividing portion 60 and a palm-side thumb-dividing portion 70.

The back-side thumb-dividing portion 60 is made of the second material and disposed between a thumb portion of the glove 100 and the back side of the glove 100.

The palm-side thumb-dividing portion 70 is made of the second material and disposed between the thumb portion of the glove 100 and the palm side of the glove 100.

The back-side thumb-dividing portion 60 may be connected with the palm-side thumb-dividing portion making the thumb portion an island completely surrounded by the second material 70 as shown in FIG. 2.

The back-side thumb-dividing portion 60 and the palm-side thumb-dividing portion 70 may be connected with one of the one or more back-dividing portions 40 for an index finger. For example, the part A in FIG. 1 may be connected with the part B in FIG. 2.

The glove 100 may further comprise a plurality of first finger-side-covering portions 80, each of which being disposed over and configured to cover a side portion of finger, and each of the plurality of first finger-side-covering portions 80 may be disposed between and connects two of the plurality of tip-covering portions 10 covering palm and back of a tip portion of finger, respectively.

The first finger-side-covering portions 80 may be made of a fourth material, wherein the second material is more flexible than the fourth material.

The glove 100 may further comprise a plurality of second finger-side-covering portions 90, each of which being disposed over and configured to cover remaining side portion of finger. Each of the plurality of second finger-side-covering portions 90 may be disposed between and connects two of the plurality of joint-covering portions 20 covering palm and back of a tip portion of finger of the glove 100, respectively, and an end of one of the plurality of second finger-side-covering portions 90 may be connected with an end of neighboring one of the plurality of first finger-side-covering portions 80.

The second finger-side-covering portions 90 may be made of a fifth material, and the second material may be more flexible than the fifth material.

The exact shapes or dimensions depend on a specific items manufactured according to the invention.

The most important inventive features of the invention are that some portions of the glove 100 may be made of more flexible material, so as to help the user of the glove 100 to feel comfortable to put it on, especially at the portions to be bent frequently. Such portions include the plurality of joint-covering portions 20.

In the above case, the frequently bendable portions are made of more flexible material such as the second material.

However, in some other portions of the glove 100, in the above embodiment, the same result can be obtained even with less flexible material such as the first material as in the first matacarpal-phalangeal joint surface-covering portion 32. Even though it the first matacarpal-phalangeal joint surface-covering portion 32 is disposed in a portion that is bent frequently, the first matacarpal-phalangeal joint surface-covering portion 32 is made of relatively strong and stiff material such as the first material with no problem. The flexibility at the first matacarpal-phalangeal joint surface-covering portion 32 could be obtained by the closely-disposed flexible parts such as joint-covering portions 20 and the back-dividing portions 40.

In certain embodiments, the first material may be the same as the third material.

In certain embodiments, even though the first and third material are same, they may have different surface texture for the back and palm sides of the glove 100. For example, the palm side may have a plurality of pockmarked structures such as protrusions.

In certain embodiments, the fourth material may be the same as the first material. Sometimes, the fourth material may have a different color from the first material.

In certain embodiments, the fifth material may have flexibility like the second material.

In certain embodiments, the glove 100 may further comprise a latching device 110 with hook-and-loop fastener, Velcro®, for having putting on and off easy.

In the illustrated embodiment shown in FIG. 1, the joint-covering portions 20 over the index finger is provided in an extended form, because the index finger needs the flexibility most.

Furthermore, the second material is more flexible than the first or third material and stretchable, such that the glove fits for a plurality of different sizes. Thanks to the more flexibility of the second material, the glove can be put on by users having different sizes of hand or fingers. For this, the other material than the second material can be made more flexible additionally.

More specifically, thanks to the more flexibility of the second material, the flexibility of each of the plurality of joint-covering portions 20 enables the glove put on by multiple sizes of hands.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A glove comprising:

a plurality of tip-covering portions, each of which being made of a first material and configured to cover each palm or back side of tip portions of fingers;

a plurality of joint-covering portions, each of which being made of a second material, connected to corresponding one of the plurality of tip-covering portions, and configured to cover one of palm or back side of joint portions of the fingers;

a plurality of surface-covering portions, each of which being made of a third material, connected to at least one of the plurality of tip-covering portions and the plurality of joint-covering portions, and configured to cover surface portions other than hand portions covered by the tip-covering portions or the joint-covering portions;

a back-side thumb-dividing portion made of the second material and disposed between a thumb portion of the glove and the back side of the glove; and a palm-side thumb-dividing portion made of the second material and disposed between the thumb portion of the glove and the palm side of the glove, wherein the second material has a higher flexibility than the first or third material, wherein the plurality of surface-covering portions comprise a first matacarpal-phalangeal joint surface-covering portion disposed over and configured to cover at least some of back sides of matacarpal-phalangeal joints;

wherein the back-side thumb-dividing portion is connected with the palm-side thumb-dividing portion, making the thumb portion an island surrounded completely by the second material;

wherein the back-side thumb-dividing portion and the palm-side thumb-dividing portion are connected with one of one or more back-dividing portions.

2. The glove of claim 1, wherein the plurality of joint-covering portions are configured to cover at least some of proximal inter-phalangeal joints of the fingers.

3. The glove of claim 1, wherein the plurality of surface-covering portions comprise a back surface-covering portion disposed over and configured to cover a partial back side of the hand portion.

4. The glove of claim 3, further comprising one or more back-dividing portions made of the second material and disposed between the first matacarpal-phalangeal joint surface-covering portion and the back surface-covering portion.

5. The glove of claim 1, wherein the plurality of surface-covering portions comprise a second matacarpal-phalangeal joint surface-covering portion disposed over and configured to cover at least some of palm sides of matacarpal-phalangeal joints.

6. The glove of claim 1, wherein the plurality of surface-covering portions comprise a palm surface-covering portion disposed over and configured to cover a partial palm side of the hand portion.

7. The glove of claim 6, further comprising one or more palm-dividing portions made of the second material and disposed between the second matacarpal-phalangeal joint surface-covering portion and the palm surface-covering portion.

8. The glove of claim 1, wherein the back-side thumb-dividing portion is connected with the palm-side thumb-dividing portion.

9. The glove of claim 8, wherein the back-side thumb-dividing portion and the palm-side thumb-dividing portion are connected with one of the one or more back-dividing portions configured for an index finger.

10. The glove of claim 1, further comprising a plurality of first finger-side-covering portions, each of which being disposed over and configured to cover a side portion of one of the fingers, wherein each of the plurality of first finger-side-covering portions is disposed between and connects two of the plurality of tip-covering portions covering palm and back of a tip portion of finger, respectively.

11. The glove of claim 10, wherein the first finger-side-covering portions are made of a fourth material, wherein the second material has a higher flexibility than the fourth material.

12. The glove of claim 10, further comprising a plurality of second finger-side-covering portions, each of which being disposed over and configured to cover remaining side portion of finger, wherein each of the plurality of second finger-side-covering portions is disposed between and connects two of the plurality of joint-covering portions covering palm and back of a tip portion of finger, respectively, and wherein an end of one of the plurality of second finger-side-covering portions is connected with an end of neighboring one of the plurality of first finger-side-covering portions.

13. The glove of claim 12, wherein the second finger-side-covering portions are made of a fifth material, wherein the second material has a higher flexibility than the fifth material.

14. The glove of claim 1, wherein the second material has a higher flexibility than the first or third material, such that the glove fits for a plurality of different sizes.

15. A glove comprising:

a plurality of tip-covering portions, each of which being made of a first material and configured to cover each palm or back side of tip portions of fingers;

a plurality of joint-covering portions, each of which being made of a second material, connected to corresponding one of the plurality of tip-covering portions, and configured to cover one of palm or back side of joint portions of the fingers;

a plurality of surface-covering portions, each of which being made of a third material, connected to at least one of the plurality of tip-covering portions and the plurality of joint-covering portions, and configured to cover surface portions other than hand portions covered by the tip-covering portions or the joint-covering portions;

a back-side thumb-dividing portion made of the second material and disposed between a thumb portion of the glove and the back side of the glove; and a palm-side thumb-dividing portion made of the second material and disposed between the thumb portion of the glove and the palm side of the glove, wherein the second material has a higher flexibility than the first or third material, wherein the plurality of surface-covering portions comprise a first matacarpal-phalangeal joint surface-covering portion disposed over and configured to cover at least some of back sides of matacarpal-phalangeal joints, wherein the plurality of surface-covering portions comprise a second matacarpal-phalangeal joint surface-covering portion disposed over and configured to cover at least one of palm sides of matacarpal-phalangeal joints, wherein the back-side thumb-dividing portion is connected with the palm-side thumb-dividing portion, making the thumb portion an island completely surrounded by the second material, wherein the back-side thumb-dividing portion and the palm-side thumb-dividing portion are connected with one of one or more back-dividing portions, wherein the plurality of joint-covering portions are configured to cover at least some of proximal inter-phalangeal joints of the fingers.

16. The glove of claim 15, further comprising one or more palm-dividing portions made of the second material and disposed between the second matacarpal-phalangeal joint surface-covering portion and the palm surface-covering portion.

17. The glove of claim 15, further comprising a plurality of first finger-side-covering portions, each of which being disposed over and configured to cover a side portion of one of the fingers, wherein each of the plurality of first finger-side-covering portions is disposed between and connects two of the plurality of tip-covering portions covering palm and back of a tip portion of finger, respectively.

18. The glove of claim 17, wherein the first finger-side-covering portions are made of a fourth material, wherein the second material has a higher flexibility than the fourth material.

19. The glove of claim 17, further comprising a plurality of second finger-side-covering portions, each of which being disposed over and configured to cover remaining side portion of finger, wherein each of the plurality of second finger-side-covering portions is disposed between and connects two of the plurality of joint-covering portions covering palm and back of a tip portion of finger, respectively, and wherein an end of one of the plurality of second finger-side-covering portions is connected with an end of neighboring one of the plurality of first finger-side-covering portions.

20. The glove of claim 19, wherein the second finger-side-covering portions are made of a fifth material, wherein the second material has a higher flexibility than the fifth material.

* * * * *